US006512168B2

(12) United States Patent
Cortes

(10) Patent No.: US 6,512,168 B2
(45) Date of Patent: Jan. 28, 2003

(54) FRETLESS GROOVED FINGERBOARD

(76) Inventor: Marco Antonio Ferreira Cortes, P.O. Box 707, Dallas, OR (US) 97338

( * ) Notice: Subject to any disclaimer, the term of this patent is extended or adjusted under 35 U.S.C. 154(b) by 0 days.

(21) Appl. No.: 09/839,338

(22) Filed: Apr. 20, 2001

(65) Prior Publication Data

US 2001/0022128 A1 Sep. 20, 2001

Related U.S. Application Data

(60) Provisional application No. 60/185,433, filed on Feb. 28, 2000.

(51) Int. Cl.[7] ..... G10D 3/00
(52) U.S. Cl. ..... 84/290; 84/293
(58) Field of Search ..... 84/314 R, 293, 84/267, 291

(56) References Cited

U.S. PATENT DOCUMENTS 2,816,469 A * 12/1957 Gossom ..... 84/293
6,156,961 A * 12/2000 Beckmeier ..... 84/293

* cited by examiner

*Primary Examiner*—Robert E. Nappi
*Assistant Examiner*—Kim Lockett
(74) *Attorney, Agent, or Firm*—Robert D. Varitz, P.C.

(57) ABSTRACT

A fingerboard for stringed musical instrument having a series of predetermined grooves located at every position in which a series of consecutive frets would have otherwise occurred, in accordance with a predetermined tonal scale, providing the facilities of a fretted fingerboard and maintaining the characteristics of a fretless fingerboard.

12 Claims, 1 Drawing Sheet

FRETLESS GROOVED FINGERBOARD

CROSS-REFERENCE TO RELATED APPLICATIONS

This application claims the benefit of U.S. Provisional Application No. 60/185,433 filed on Feb. 28, 2000.

BACKGROUND—FIELD OF INVENTION

This invention relates to musical instruments, specifically to a tuning system for stringed musical instruments.

BACKGROUND—DESCRIPTION OF PRIOR ART

Stringed musical instruments commonly are configured having a relatively narrow neck structure. The neck structure usually has an end at which the instrument strings are attached in such a manner as to permit adjusting the tension of the strings, and has another end affixed to a body on which a bridge or saddle is provided to secure the opposite ends of these strings. The neck generally has a structural portion having an exposed surface below the strings, which is the fingerboard.

The fingerboard is classified in two types: fretted type and fretless type. A fretted fingerboard has a series of ridges fixed across the fingerboard, spaced apart from one another that project above a larger, major fingerboard surface. Each member of this series of structures has its axis of elongation provided transversely to the major axis of the neck, and each is located at a precise location along the length of the fingerboard. A fingerboard may have an upper surface, which is transversely planar or transversely arcuate.

The purpose of fingerboard frets is to permit the individual playing the instrument to shorten the effective length of the vibrating portion of a string positioned thereover. The individual or musician is enabled to select the effective lengths of the string at precise points, each of which is determined using the fret chosen by the musician for this purpose, to thereby alter the pitch or frequency of the sound produced by the vibrating string. If the individual stops the string against the fingerboard major surface on the side of the fret opposite the bridge or saddle, the string will also be stopped against that fret and a precise vibration frequency in the string can thus be set determined by the distance of the fret from the bridge or saddle. Frets promote the facility of playing the correct or perfect pitch, however they impede the smooth on changing musical notes occurred in a fretless fingerboard.

In fretless fingerboard, the string is stopped against the fingerboard surface by the musician wherever the individual chooses, and the resulting vibration frequency of that portion of the string between this stop point and the bridge or saddle is determined by the precise position of the point at which the string is stopped. Hence, there is no fret to stop the string against to provide a corresponding fixed frequency of vibration of string and the vibration frequency will change slightly with slight shifts in the stop point chosen by the placement of the musician's finger. Consequently, the point at which the string is stopped in a fretless fingerboard is more critical in determining the resulting vibration frequency of the string than is the point at which it is stopped in a fretted fingerboard, the latter requiring only that the string be stopped behind the fret to give a known frequency associated with that fret. Thus, a large range of frequencies for a vibrating string can be selected by a musician playing a fretless fingerboard than can be selected by a musician playing a fretted fingerboard. However, there is a large difficulty degree forming the correct or perfect pitch in a fretless fingerboard.

Instruments are available which have marks in substitution at every fret on the fingerboard. There is no difference between a regular fretless fingerboard and the fingerboard referred above.

There is further the need for a fretless fingerboard that allows the musician the flexibility to play an instrument without frets however with its sound characteristics and maintaining the facilities provided by a fretted fingerboard. This invention provides the solution for this need.

SUMMARY

The invention relates to a device to allow a fretless stringed musical instrument to be played with the same facilities of a fretted stringed musical instrument without losing the fretless instrument characteristics.

Accordingly, several objects and advantages of the present invention are:

(a) to provide the characteristics of a fretless instrument and also the characteristics of a fretted instrument in a single fingerboard;

(b) to provide to the musician to play chords almost impossible to be played in an instrument without frets;

(c) to provide to the musician an easier method or way to form the correct or perfect pitch at an instrument without frets.

Reference Numeral in Drawings

| | |
|---|---|
| 10 | guitar |
| 12 | grooves |
| 12b | body-side margin of groove |
| 13 | island |
| 14 | neck |
| 16 | fingerboard |
| 18 | head |
| 20 | strings |
| 22 | bridge |
| 24 | body |

DETAILED DESCRIPTION OF THE INVENTION

Figure 1:
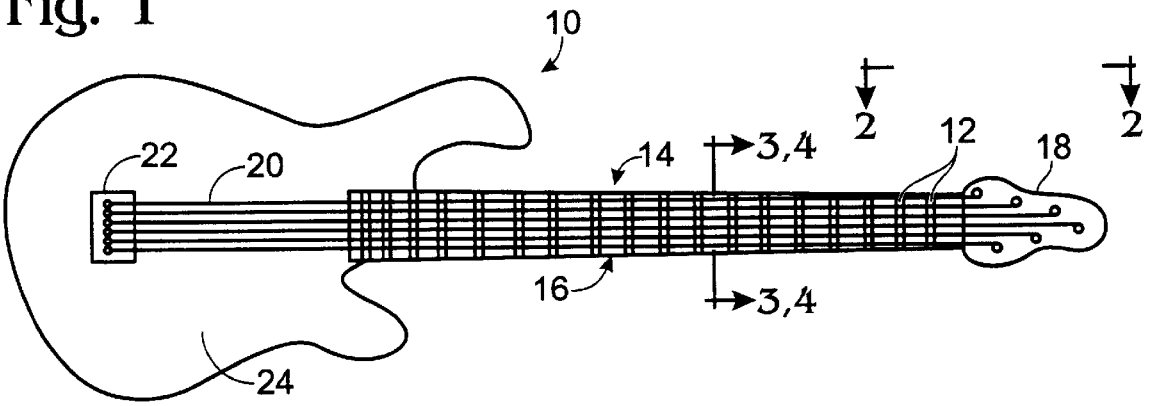
FIG. 1 is a plain view showing a guitar.

Referring to FIG. 1, illustrates a guitar generally designated by reference numeral 10 and embodying the invention. As seen in this FIG., a guitar 10 comprises a body 24, a neck 14, a fingerboard 16 within a plurality of grooves 12 are located, a head 18, series of strings 20, and a bridge 22.

Figure 2:
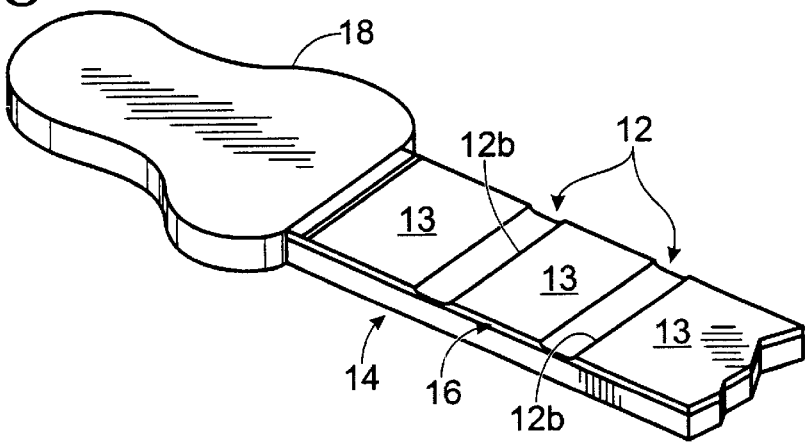
FIG. 2 is a perspective view, along line 2—2 of FIG. 1.

Referring to FIG. 2, a portion of a guitar neck 14 is shown. The fingerboard 16 is seen to include a plurality of transverse grooves 12 each at the proper location to provide the appropriate musical pitch for the instrument. Each groove includes a body-side margin 12*b* located at the juncture between the fingerboard and the groove on the side of the groove closest to body 24. Each of the grooves 12 are seen to be disposed transversely with respect to the longitudinal dimension of the fingerboard 16 as indicated by the direction of the strings 20. An island 13 is located between adjacent grooves along the length of fingerboard 16.

These series of grooves 12 are the main point of the invention. In this invention, when the string 20 is stopped by the musician against the space between two grooves 12, the fingerboard 16 works as a fretless fingerboard 16 providing a considerably wider range of frequencies. And if the string 20 is stopped inside of any groove 12, against its edge (the edge in the direction of the bridge), this groove 12 will work as the same function as a fret, providing a known frequency associated with the position of that specific groove 12.

The grooves 12 may be made in any format or shape and each being located at a different predetermined distance from bridge 22 to provide a given tonal scale. At the experiments with the prototypes of the invention the distance between the transverse edges of each groove 12 is 3 mm and has a depth of 2 mm. Those dimensions are variable in accordance with a predetermined fingerboard 16. The grooves could be routed, carved, punctured, opened using any abrasive method or any other method which would provide a predetermined groove 12.

Figure 3:
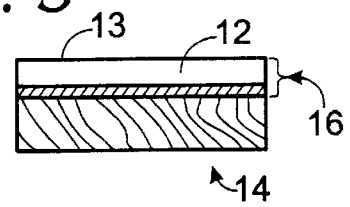
FIG. 3 is a section of a planar fingerboard taken along line 3—3 of FIG. 1.
Figure 4:
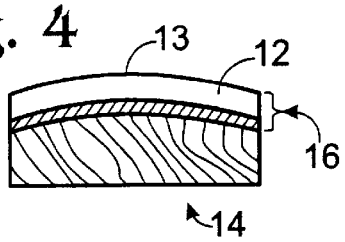
FIG. 4 is a section of an arcuate fingerboard taken along line 4—4 of FIG. 1.

FIG. 3 depicts a section of a fingerboard, which has a transversely planar upper surface, such as a guitar. FIG. 4 depicts a section of a fingerboard, which has a transversely arcuate upper surface, such as a violin.

While the above provides a fall and complete disclosure of the preferred embodiments of the invention, various modifications, alternate constructions and equivalents may be employed without departing from the true spirit and scope of the invention. Therefore the above description and illustrations should not be construed as limiting the scope of the invention which is defined by the appended claims.

I claim:

1. A fingerboard for use on a stringed musical instrument having at least one string thereon, wherein the stringed musical instrument has a body, a bridge located on the body, and a head spaced apart from the body, wherein the fingerboard has an upper surface which extends between the body and the head, and wherein a string extends between the head and the body over the bridge comprising:

a plurality of transverse grooves, each groove having a body-side margin thereof coincident with the upper surface of the fingerboard;

a plurality of islands, wherein each groove is located between adjacent islands;

wherein a user depresses a string, thereby forming a stop point, on either of an island or on a groove body-side margin; and wherein said grooves are spaced-apart from one another such that:

when a stop point is formed on a groove body-side margin and a string caused to vibrate, a scalar note of a tonal scale is sounded; and when a stop point is formed on an island and a string caused to vibrate, a non-scalar note is sounded.

2. The fingerboard of claim 1 wherein said fingerboard is transversely planar.

3. The fingerboard of claim 1 wherein said fingerboard is transversely arcuate.

4. The fingerboard of claim 1 wherein said grooves have a depth of about 2 mm.

5. The fingerboard of claim 1 wherein said grooves have a width of about 3 mm.

6. The fingerboard of claim 1 wherein said grooves are spaced at tonal intervals along the length of the fingerboard.

7. A fingerboard for use on a stringed musical instrument having at least one string thereon, wherein the stringed musical instrument has a body, a bridge located on the body, and a head spaced apart from the body, wherein the fingerboard has an upper surface which extends between the body and the head, and wherein a string extends between the head and the body over the bridge comprising:

a longitudinally planar surface having a plurality of transverse grooves extending thereacross, wherein each groove has a body-side margin thereof coincident with the upper surface of said longitudinally planar surface;

a plurality of islands located on said longitudinally planar surface, wherein each groove is located between adjacent islands;

wherein a user depresses a string, thereby forming a stop point, on either of an island or on a groove body-side margin; and wherein said grooves are spaced-apart from one another such that:

when a stop point is formed on a groove body-side margin and a string caused to vibrate, a scalar note of a tonal scale is sounded; and when a stop point is formed on an island and a string caused to vibrate, a non-scalar note is sounded.

8. The fingerboard of claim 7 wherein said fingerboard is transversely planar.

9. The fingerboard of claim 7 wherein said fingerboard is transversely arcuate.

10. The fingerboard of claim 7 wherein said grooves have a depth of about 2 mm.

11. The fingerboard of claim 7 wherein said grooves have a width of about 3 mm.

12. The fingerboard of claim 7 wherein said grooves are spaced at tonal intervals along the length of the fingerboard.

* * * * *